US012226817B2

(12) United States Patent
Sorkin

(10) Patent No.: US 12,226,817 B2
(45) Date of Patent: Feb. 18, 2025

(54) PORTABLE CUTTING LINE

(71) Applicant: Felix Sorkin, Stafford, TX (US)

(72) Inventor: Felix Sorkin, Stafford, TX (US)

( * ) Notice: Subject to any disclaimer, the term of this patent is extended or adjusted under 35 U.S.C. 154(b) by 436 days.

(21) Appl. No.: 17/572,766

(22) Filed: Jan. 11, 2022

(65) Prior Publication Data

US 2022/0219348 A1 Jul. 14, 2022

Related U.S. Application Data

(60) Provisional application No. 63/136,949, filed on Jan. 13, 2021.

(51) Int. Cl.
*B21F 45/00* (2006.01)
*B65D 88/12* (2006.01)

(52) U.S. Cl.
CPC ..... *B21F 45/006* (2013.01); *B65D 88/121* (2013.01); *Y10T 29/5135* (2015.01); *Y10T 29/5142* (2015.01); *Y10T 29/5145* (2015.01)

(58) Field of Classification Search
CPC ..... B21F 45/006; B21F 11/00; B21C 47/045; B21C 47/18; Y10T 29/5124; Y10T 29/5135; Y10T 29/5142; Y10T 29/5145; Y10T 29/5139; Y10T 29/49632; B65D 88/121; B65D 88/12
USPC .. 29/563, 38.9, 564.6, 564.8, 564.3, 897.34; 242/521–527.7
See application file for complete search history.

(56) References Cited

U.S. PATENT DOCUMENTS

| | | | | |
|---|---|---|---|---|
| 224,942 | A * | 2/1880 | Morgan et al. | B21C 47/14 242/533.4 |
| 2,275,563 | A * | 3/1942 | Sharlow | B21F 1/023 15/97.1 |
| 2014/0373587 | A1* | 12/2014 | Harding | B21D 3/02 72/183 |
| 2018/0311714 | A1 | 11/2018 | Taylor et al. | |

FOREIGN PATENT DOCUMENTS

| | | | |
|---|---|---|---|
| CN | 111229994 | A | 6/2020 |
| CN | 211386698 | U | 9/2020 |
| DE | 202020000156 | U1 * | 5/2020 |
| JP | H03180234 | A | 8/1991 |
| WO | 2019185636 | A1 | 3/2019 |
| WO | WO-2021/052770 | A1 * | 3/2021 |

OTHER PUBLICATIONS

Machine Translation of JP 03-180234 A, which JP '234 was published Aug. 1991.*
Machine Translation of DE 202020000156 U1, which DE '156 was published May 2020.*
Communication pursuant to Article 94(3) EPC dated Jun. 6, 2023 issued EP22151101.7.
Extended European Search Report dated Jun. 13, 2022 issued in EP 22151101.7.

* cited by examiner

*Primary Examiner* — Erica E Cadugan
(74) *Attorney, Agent, or Firm* — Hunton Andrews Kurth LLP

(57) ABSTRACT

A portable cutting line may include a frame and a lazy susan. The portable cutting line may also include a cutting line main table, the cutting line main table operatively connected to the lazy susan and one or more tubs, the tubs operatively connected to the cutting line main table. The lazy susan, the cutting line main table, and the one or more tubs may be positioned within the frame when in transport position.

22 Claims, 8 Drawing Sheets

PORTABLE CUTTING LINE

CROSS-REFERENCE TO RELATED APPLICATIONS

This application is a nonprovisional application which claims priority from U.S. provisional application No. 63/136,949, filed Jan. 13, 2021, which is incorporated by reference herein in its entirety.

TECHNICAL FIELD/FIELD OF THE DISCLOSURE

The present disclosure is directed to a portable cutting line.

BACKGROUND OF THE DISCLOSURE

Many structures are built using concrete, including, for instance, buildings, parking structures, apartments, condominiums, hotels, mixed-use buildings, casinos, hospitals, medical buildings, government buildings, research/academic institutions, industrial buildings, malls, bridges, pavement, tanks, reservoirs, silos, foundations, sports courts, and other structures.

Pre-stressed concrete is structural concrete in which internal stresses are introduced to reduce potential tensile stresses in the concrete resulting from applied loads. This can be accomplished by two methods—pre-tensioned pre-stressing and post-tensioned pre-stressing. When post-tensioning concrete, the pre-stressing assembly is tensioned after the concrete has cured to a specified strength. The pre-stressing assembly, commonly known as a tendon, may include for example and without limitation, anchorages, one or more strands, and sheaths or ducts surrounding the strand(s). A strand may be tensioned between a pair of anchors, which are embedded in the concrete. The strand may be formed from a metal or composite or any suitable material exhibiting tensile strength, including, for example and without limitation, reinforcing steel, single wire cable, or multi-wire cable. The strand is typically fixedly coupled to a fixed anchorage positioned at one end of the tendon, the so-called "fixed end", and is adapted to be stressed at the other anchor, the "stressing end" of the tendon. The strand is generally retained in each anchor by one or more wedges that engage a tapered recess in the anchor body so that when the strand is placed under tension, the wedges engage the strand more tightly.

One end of the strand extends through the stressing end anchor and out of the concrete body in which the anchor is embedded. In some cases, a pocket former is placed around the strand before the concrete is poured, which results in a pocket in the cured concrete. In these cases, the end of the strand extends through and outwardly from the pocket. Once the concrete has cured, a tensile force can be applied to the extending strand end, causing an elongation of the strand. Releasing the tensile force causes the strand to be more tightly gripped by the wedges, thereby maintaining its elongated stress, which is transferred to the concrete via the anchors. The portion of the strand that extends out of the stressing anchor is typically removed.

SUMMARY

The present disclosure provides for a portable cutting line. The portable cutting line may include a frame and a lazy susan. The portable cutting line may also include a cutting line main table, the cutting line main table operatively connected to the lazy susan and one or more tubs, the tubs operatively connected to the cutting line main table. The lazy susan, the cutting line main table, and the one or more tubs may be positioned within the frame when in transport position.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
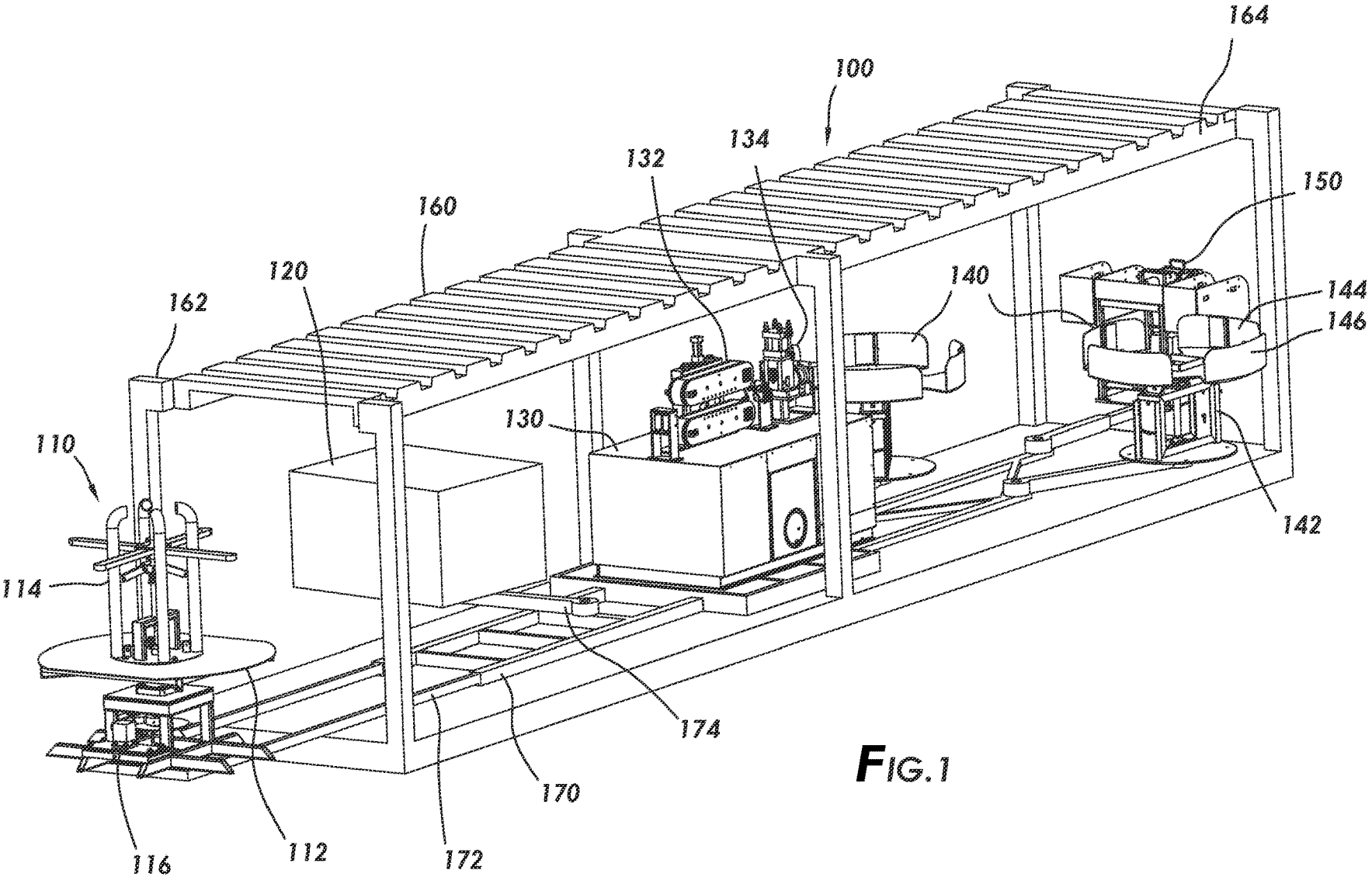
FIG. 1 is an is an isometric drawing of a portable cutting line consistent with at least some embodiments of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

In preparing a strand for post-tensioning, a mill may supply a spool of cable. The cable may be single or multi-strand. For example, the mill may extrude the cable, apply grease, and sheathing, and coil. Certain embodiments of the present disclosure are directed to a portable cutting line for forming a strand from the spool supplied by the mill. FIG. 1 depicts portable cutting line 100. Portable cutting line 100 includes lazy susan 110, cutting line main table 130, and at least one tub 140. Lazy susan 110 includes turntable 112 and may include retaining arms 114. Lazy susan 110 is adapted to receive the spool of cable. Lazy susan 110 may be driven or not driven. When driven, lazy susan 110 may include driving mechanism 116 such as a motor to turn lazy susan 110 and thereby unspool the cable for use in cutting line main table 130. When not driven, lazy susan 110 may turn and unspool the cable as the cable is pulled by cutting line main table 130.

Lazy susan 110 is operatively connected to cutting line main table 130. Cutting line main table 130 is adapted to receive the cable from lazy susan 110 and shear the cable to form a strand. In certain embodiments, cutting line main table 130 includes catapuller 132 and shear 134.

Figure 1A:
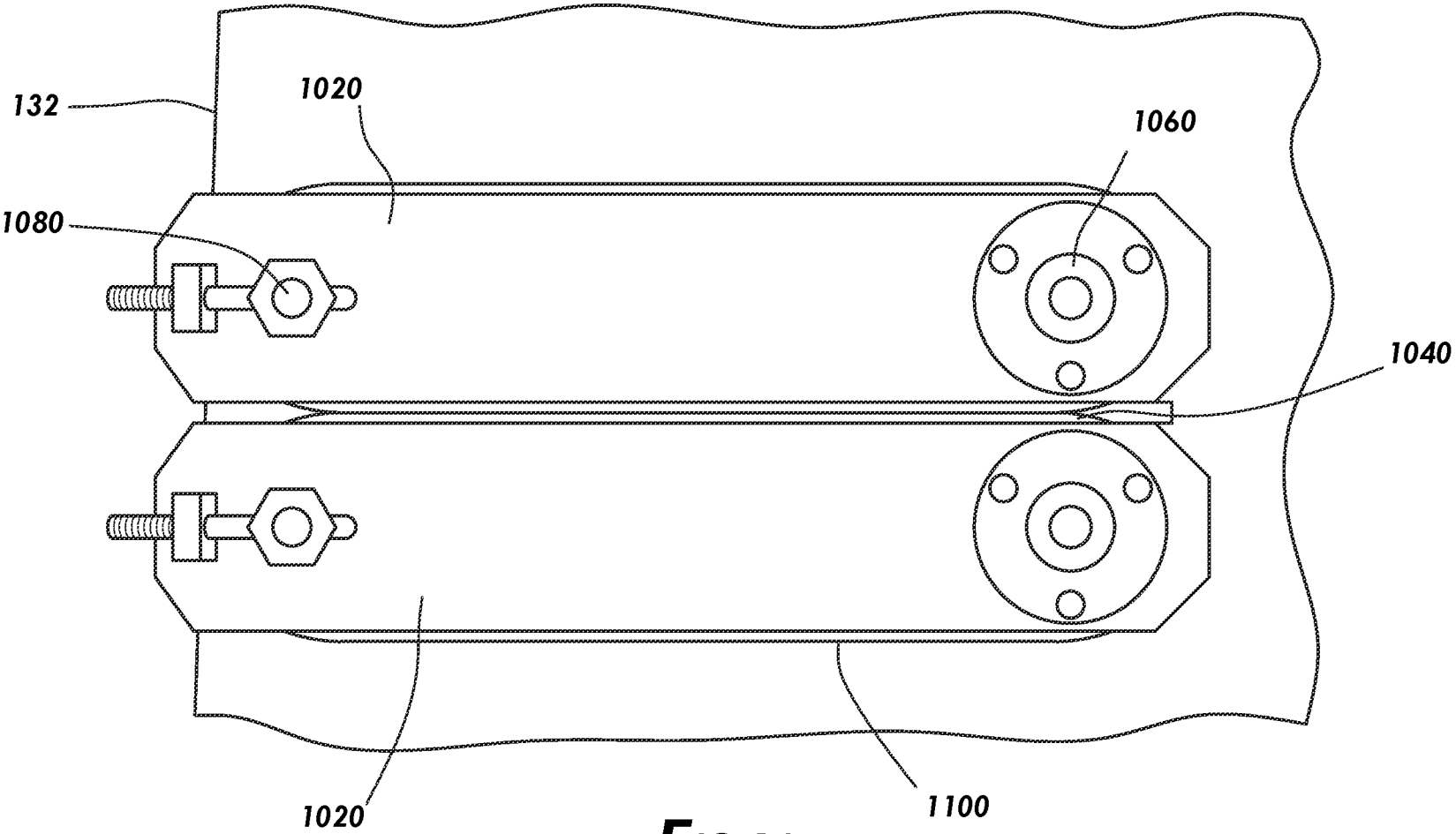
FIG. 1A is a schematic of a catapuller consistent with at least some embodiments of the present disclosure.
Figure 2:
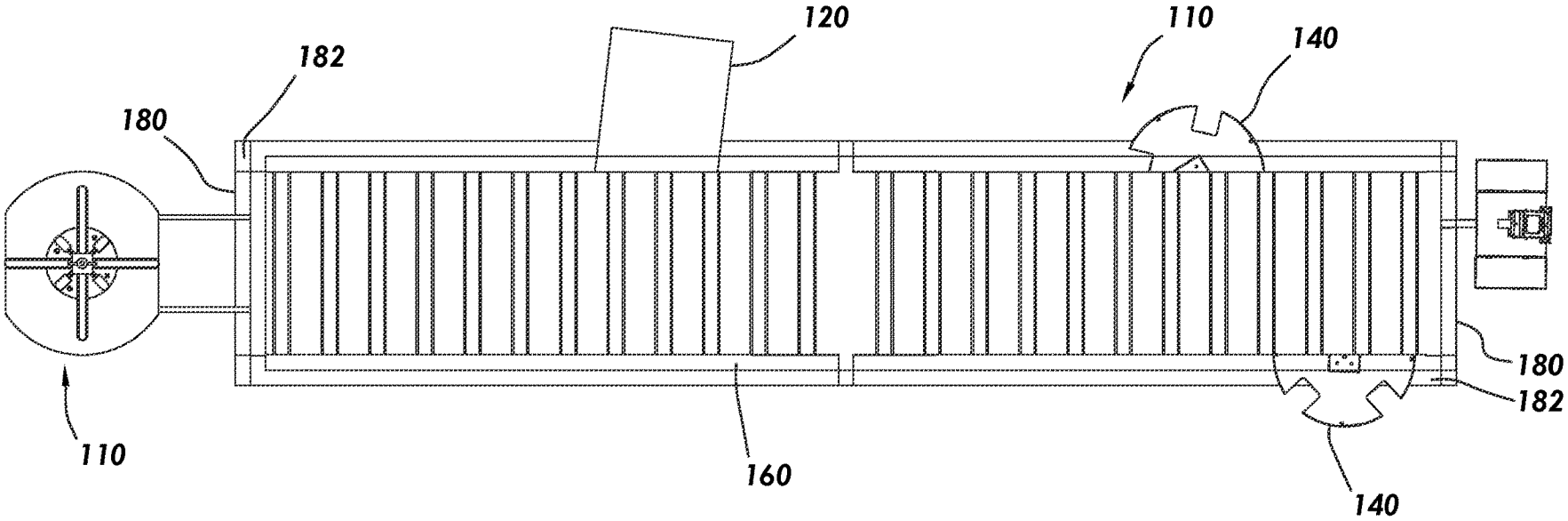
FIG. 2 is an overhead view of a portable cutting line consistent with at least some embodiments of the present disclosure.

Catapuller 132 may be any mechanism adapted to pull the cable from lazy susan 110 and feed the cable to shear 134. As shown in FIG. 1A, catapuller 132 may include catapuller bodies 1020. Catapuller bodies 1020 are separated by gap 1040, through which the cable may be pulled by catapuller 132. Each catapuller body 1020 includes drive mechanism 1060, which, as shown in FIG. 2, may be a drive wheel, and retaining wheel 1080. Loop 1100 is positioned around drive mechanism 1060 and retaining wheel 1080. Loop 1100 may be, for example, a belt or chain. As drive mechanism 1060 rotates, loop 1100 is pulled through gap 1040, causing the cable to be pulled through catapuller 132.

Shear 134 may include at least one sharp edge for cutting or shearing the cable to form the strand. In certain embodiments, shear 134 may include a rotating blade and a fixed blade. Shear 134 may be operated manually, electrically, pneumatically, or hydraulically, for example.

In certain embodiments, cutting line main table 130 may include roller box 131. Roller box 131 may align the cable upstream of catapuller 132.

Cutting line main table 130 may include line counter 135. Line counter 135 may measure the length of the cable as pulled through catapuller 132. In addition, in certain embodiments, cutting line main table 130 may include tub selector 136, such as when portable cutting line 100 includes more than one tub 140. Tub selector 136 determines which of the plurality of tubs 140 the strand is transferred.

Portable cutting line 100 may include one or more tubs 140. One or more tubs 140 are operatively connected to and adapted to receive the strand from cutting line main table 130 and spool the strand. In the non-limiting embodiment shown in FIG. 1, tubs 140 include tub base 142 and strand receiving area 144. Tub base 142 may rotate so as to spool strands received from cutting line main table 130. Rotation of tub base 142 may be driven, i.e., turned manually, electrically, pneumatically, or hydraulically. Strand receiving area 144 may include one or more sides 146 to hold the strand spool in place.

Portable cutting line 100 may also include power source 120. Power source 120 may provide power to, and be operatively connected to, lazy susan 110, cutting line main table 130, tubs 140, and, in certain embodiments, seater station 150. Power source 120 may supply electrical power, air for pneumatic power, or hydraulic power. In certain embodiments, power source 120 is a generator for providing electrical power.

In certain embodiments, portable cutting line 100 may include seater station 150. Seater station 150 may be used to fasten an anchor to one end of the strand. In other embodiments, seater station 150 is not included in portable cutting line 100.

Figure 6:
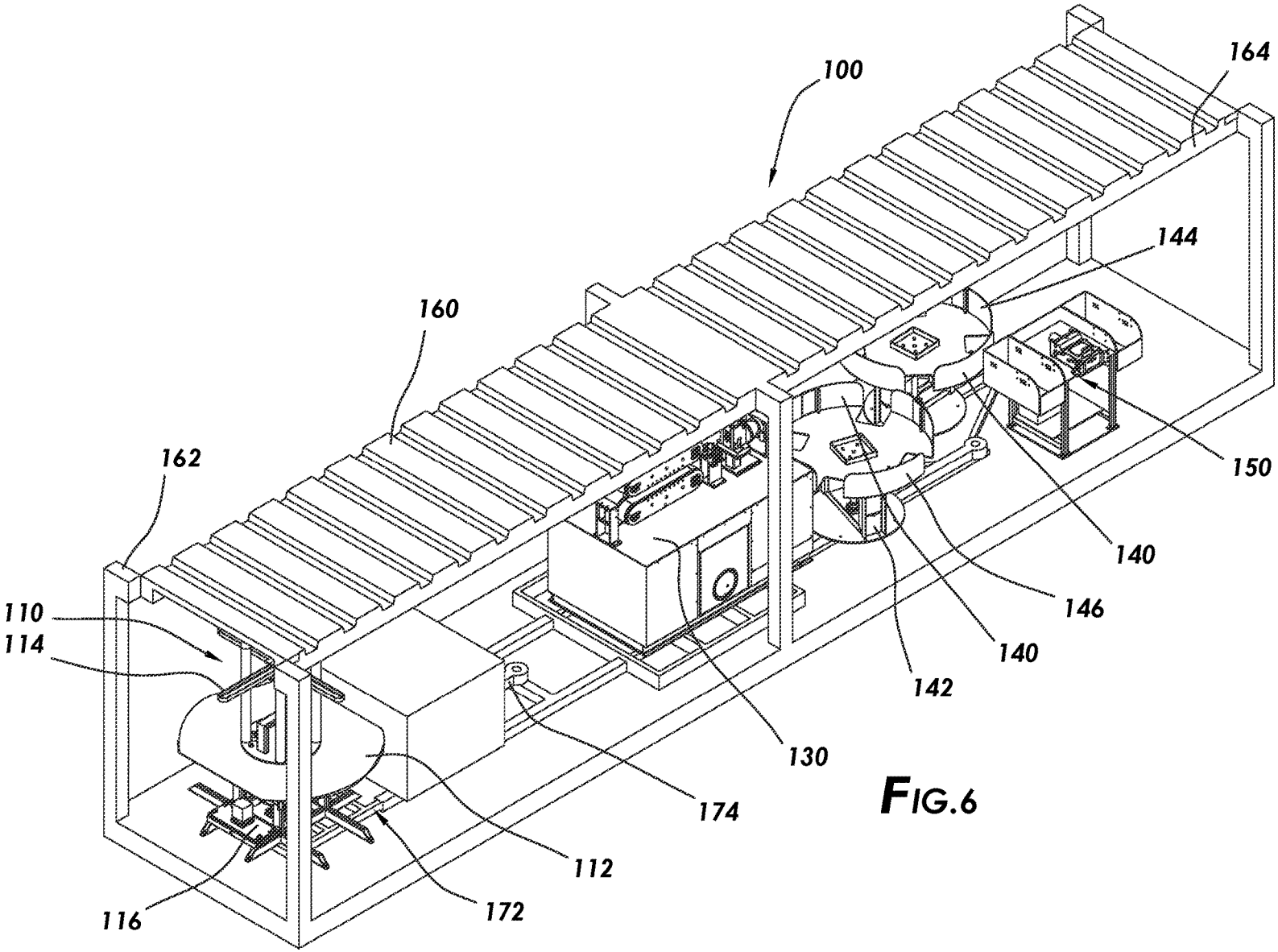
FIG. 6 is an isometric drawing of a portable cutting line consistent with at least some embodiments of the present disclosure.
Figure 7:
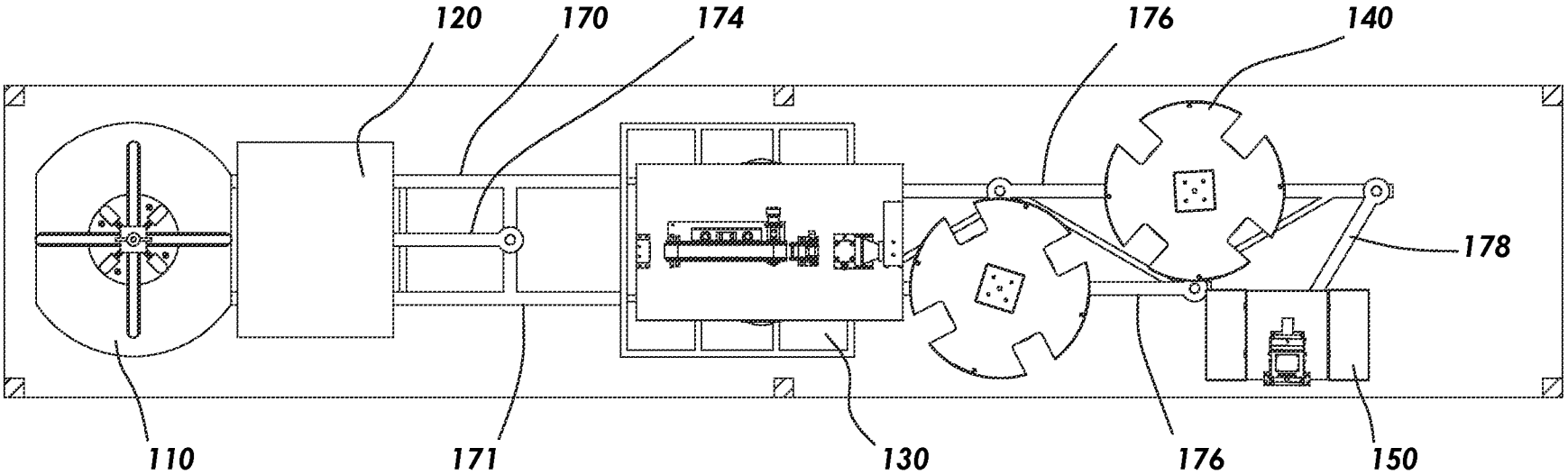
FIG. 7 is an overhead view of a portable cutting line consistent with at least some embodiments of the present disclosure.
Figure 8:
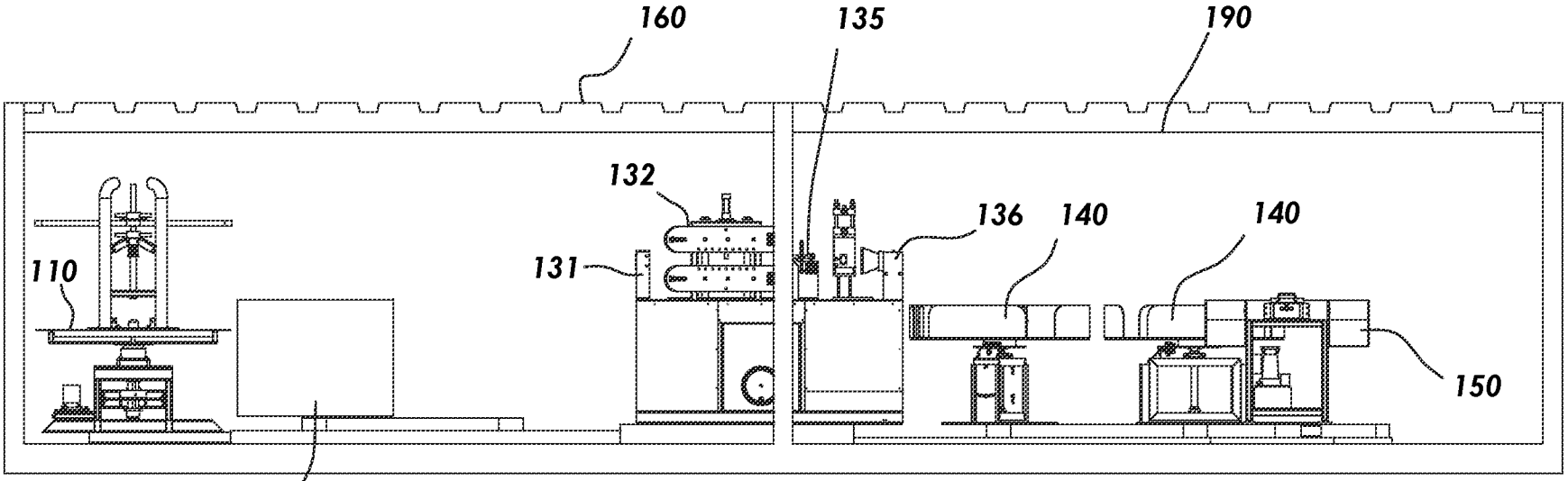
FIG. 8 is a side view of a portable cutting line with sides flipped up consistent with at least some embodiments of the present disclosure.
Figure 8C:
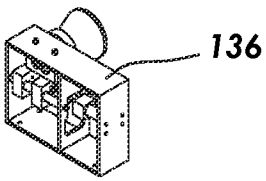
FIGS. 8A-8C are schematic views of portions of the portable cutting line consistent with at least some embodiments of the present disclosure.
Figure 8B:
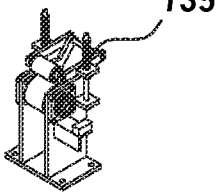
Figure 8A:
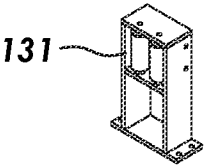

In certain embodiments, portable cutting line 100 may include a transport position, as shown in FIGS. 6-8, and an operation position, as shown in FIGS. 1-5. In the transport position, portable cutting line 100 may be positioned within frame 160. In certain embodiments, frame 160 may be a shipping container. In the transport position, all elements of portable cutting line 100 may be positioned within frame 160.

Figure 3:
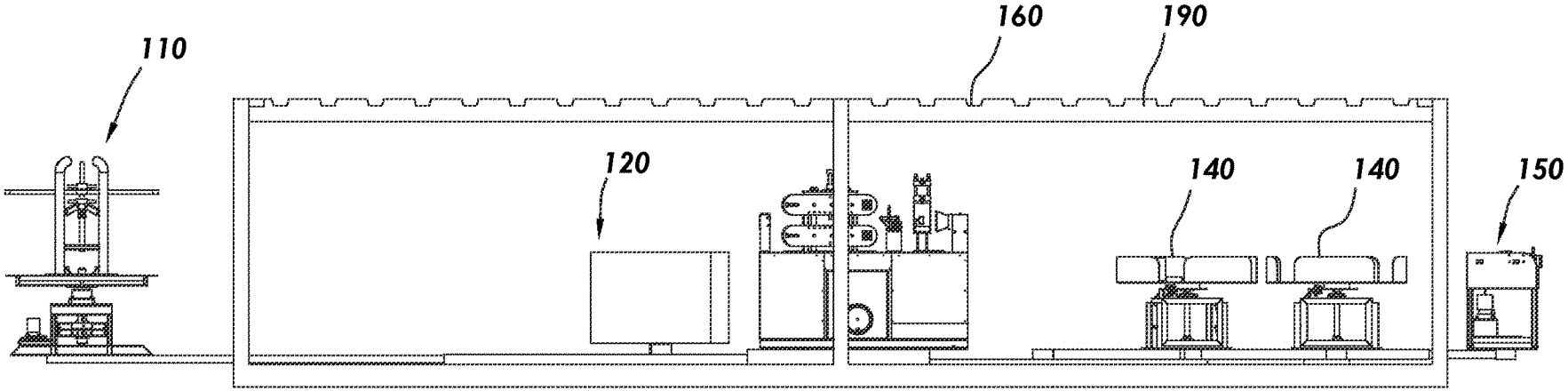
FIG. 3 is a side view of a portable cutting line with sides flipped up consistent with at least some embodiments of the present disclosure.
Figure 4:
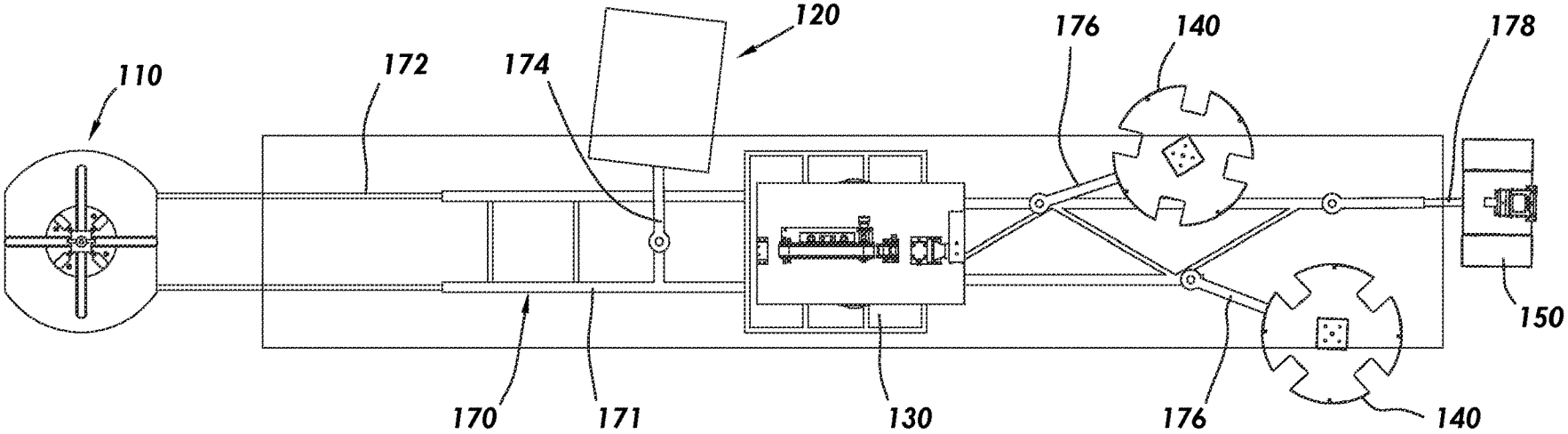
FIG. 4 is an overhead cutaway view of the portable cutting line consistent with at least some embodiments of the present disclosure.
Figure 5:
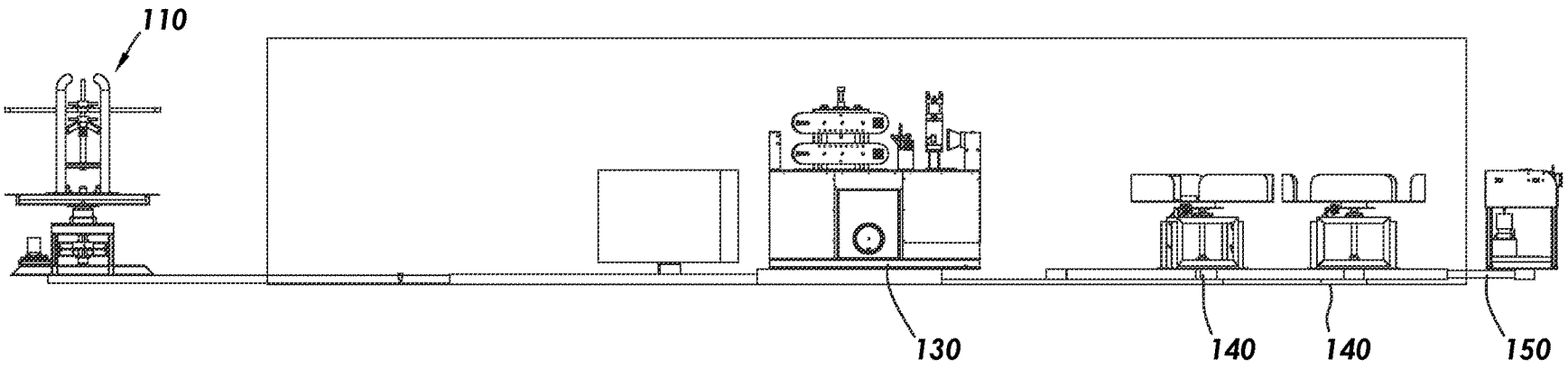
FIG. 5 is side cutaway view of the portable cutting line consistent with at least some embodiments of the present disclosure.

In the operation position, elements of portable cutting line 100 are moved outside of frame 160. In some embodiments, lazy susan 110 may be moved along the long axis of frame 160 to increase the distance between cutting line main table 130 and lazy susan 110, as shown in FIGS. 1-5. As shown in FIGS. 2 and 4, power source 120 may swing to be outside side 162 of frame 160 defined by the long axis of frame 160, so as to remove power source 120 from the path of the cable between lazy susan 110 and cutting line main table 130. As further show in FIGS. 2 and 4, tubs 140 may swing to be partially or completely outside sides 162 and 164 (also defined by the long axis of frame 160). In certain embodiments, as shown in FIG. 4, seater station 150 may be moved along the long axis of frame 160 to increase the distance between seater station 150 and one or more tubs 140.

FIGS. 1 and 4 depict an embodiment for the operation position of portable cutting line 100. In this embodiment, portable cutting line 100 includes extension 170 positioned at least partially within frame 160. Extension 170 may include center rail 171. Lazy susan rail 172 may be mechanically connected to lazy susan 110 and may extend from center rail 171, thereby moving lazy susan 110 from the transport position to the operation position. Extension 170 may also include generator rotator arm 174 rotatably attached to center rail 171 and mechanically connected to power source 120. By rotating generator rotator arm 174 relative to center rail 171, power source 120 may be swung into the operation position. Further, extension 170 may include one or more tub rotator arms 176 rotatably attached to center rail 171 and mechanically connected to tubs 140. By rotating rotator arm 176, tub 140 may be swung into the operation position. In certain embodiments, extension 170 may include seater station rail 178. Seater station rail 178 may extend from center rail 171 or be rotatably connected to center rail 171, for example and mechanically connected to seater station 150. By extending or rotating seater station rail 178, seater station 150 may be moved into the operation position.

In certain embodiments, such as when frame 160 is a shipping container, ends 180 of frame 160 may be removable, or as shown in FIG. 2, be adapted to swing on hinge 182 to expose an interior of frame 160 and allow lazy susan 110 and seater station 150 to move to the operation position. Further, as shown in FIG. 3, sides 190 of frame 160 may be removable or may flip up to expose the interior of frame 160 and to allow tubs 140 and power source 120 to be swung into the operation position.

What is claimed is:

1. A portable cutting line, the portable cutting line comprising:

a frame;

a lazy susan;

a cutting line table, the cutting line table operatively connected to the lazy susan; and one or more tubs, wherein at least one of the one or more tubs is operatively connected to the cutting line table;

wherein the lazy susan, the cutting line table, and the one or more tubs are positioned within the frame when in a transport position; and wherein the portable cutting line further comprises:

a seater station operatively connected to the cutting line table;

a power source adapted to provide electrical power, air for pneumatic power, or hydraulic power to one or more of the lazy susan, the one or more tubs, or the seater station;

an extension positioned at least partially within the frame wherein the extension includes a rail and wherein the extension includes a rotator arm mechanically connected to the power source and rotatably connected to the rail.

2. The portable cutting line of claim 1, wherein the lazy susan comprises a turntable.

3. The portable cutting line of claim 2, wherein the turntable is a driven turntable.

4. The portable cutting line of claim 1, wherein the cutting line table comprises a catapuller.

5. The portable cutting line of claim 4, wherein the lazy susan is adapted to receive a spool of cable and wherein the cutting line table comprises a counter configured to measure the length of the cable as pulled through the catapuller.

6. The portable cutting line of claim 1, wherein the cutting line table comprises a shear.

7. The portable cutting line of claim 1, wherein the extension further includes a lazy susan rail extending from the rail and mechanically connected to the lazy susan.

8. The portable cutting line of claim 1, wherein the frame is a shipping container.

9. The portable cutting line of claim 8, wherein the frame includes ends that are adapted to be removable or adapted to swing on a hinge.

10. The portable cutting line of claim 8, wherein the frame includes sides that are adapted to be removable or be adapted to flip up.

11. The portable cutting line of claim 1, wherein the lazy susan, cutting line table, and the one or more tubs are adapted to be converted from the transport position to an operation position.

12. A portable cutting line, the portable cutting line comprising:

a frame;

a lazy susan;

a cutting line table, the cutting line table operatively connected to the lazy susan; and one or more tubs, wherein at least one of the one or more tubs is operatively connected to the cutting line table;

wherein the lazy susan, the cutting line table, and the one or more tubs are positioned within the frame when in a transport position; and wherein the portable cutting line further comprises:

a seater station operatively connected to the cutting line table;

a power source adapted to provide electrical power, air for pneumatic power, or hydraulic power to one or more of the lazy susan, the one or more tubs, or the seater station;

an extension positioned at least partially within the frame wherein the extension includes a rail and wherein the extension includes one or more tub rotator arms mechanically connected to the one or more tubs and rotatably connected to the rail.

13. The portable cutting line of claim 12, wherein the lazy susan comprises a turntable.

14. The portable cutting line of claim 13, wherein the turntable is a driven turntable.

15. The portable cutting line of claim 12, wherein the cutting line table comprises a catapuller.

16. The portable cutting line of claim 15, wherein the lazy susan is adapted to receive a spool of cable and wherein the cutting line table comprises a counter configured to measure the length of the cable as pulled through the catapuller.

17. The portable cutting line of claim 12, wherein the cutting line table comprises a shear.

18. The portable cutting line of claim 12, wherein the extension further includes a lazy susan rail extending from the rail and mechanically connected to the lazy susan.

19. The portable cutting line of claim 12, wherein the frame is a shipping container.

20. The portable cutting line of claim 19, wherein the frame includes ends that are adapted to be removable or adapted to swing on a hinge.

21. The portable cutting line of claim 19, wherein the frame includes sides that are adapted to be removable or be adapted to flip up.

22. The portable cutting line of claim 12, wherein the lazy susan, cutting line table, and the one or more tubs are adapted to be converted from the transport position to an operation position.

* * * * *